US009230520B2

(12) United States Patent
Mancke

(10) Patent No.: US 9,230,520 B2
(45) Date of Patent: Jan. 5, 2016

(54) PICCOLO

(71) Applicant: Tobias Mancke, Speicher (DE)

(72) Inventor: Tobias Mancke, Speicher (DE)

( * ) Notice: Subject to any disclaimer, the term of this patent is extended or adjusted under 35 U.S.C. 154(b) by 0 days.

(21) Appl. No.: 14/684,088

(22) Filed: Apr. 10, 2015

(65) Prior Publication Data

US 2015/0294654 A1 Oct. 15, 2015

(30) Foreign Application Priority Data

Apr. 11, 2014 (DE) ..... 10 2014 105 180

(51) Int. Cl.
*G10D 7/02* (2006.01)

(52) U.S. Cl.
CPC ..... *G10D 7/026* (2013.01)

(58) Field of Classification Search
CPC ..... G10D 7/026
USPC ..... 84/384
See application file for complete search history.

(56) References Cited

U.S. PATENT DOCUMENTS

| | | | | |
|---|---|---|---|---|
| 2,544,033 | A * | 3/1951 | Lawrence | G10D 7/026 84/384 |
| 5,249,499 | A * | 10/1993 | Goldstein | G10D 9/005 84/386 |
| 8,183,449 | B2 * | 5/2012 | Paulus | G10D 7/066 84/382 |
| 8,669,449 | B1 * | 3/2014 | Feliciano | G10D 7/026 84/384 |
| 2012/0011987 | A1 * | 1/2012 | Braun | G10D 7/026 84/384 |

FOREIGN PATENT DOCUMENTS

DE 102011010124 A1 1/2012

* cited by examiner

*Primary Examiner* — Jianchun Qin
(74) *Attorney, Agent, or Firm* — Jennifer S. Stachniak

(57) ABSTRACT

A piccolo having a flute body (25) with tone holes; a head piece (10) having a mouth hole (12) and a head piece body; at least one tube piece formed, respectively, on the flute body (25) and head piece (10). The flute body (25) and the head piece (10) are connectable to one another via said at least one tube piece, wherein said at least one tube piece slidingly engage in one another. The flute body (25) and head piece (10) are displaceable relative to one another based on said slidingly arranged at least one tube piece. An axial pin tube (14) is formed on an end of the head piece (10) to be connected with the flute body (25) and projects from the head piece body. An annular adapter socket (16) is slidingly and interchangeably positioned onto the pin tube (14) and secured to the pin tube (14).

10 Claims, 2 Drawing Sheets

PICCOLO

CROSS REFERENCE TO RELATED APPLICATIONS

The instant application should be granted the priority date Apr. 11, 2014, the filing date of the corresponding German patent application DE 102014105180.

BACKGROUND OF THE INVENTION

The invention relates to a flute body having tone holes and a head piece having a mouth hole, whereby the flute body and head piece are connected to one another by means of tube pieces formed, respectively on the flute body and the head piece, which are insertable into one another, and whereby the flute body and head piece are displaceable relative to one another based on the tube pieces slidingly arranged in one another.

A piccolo with the above-noted features is described in DE 10 2011 010 124 A1, whereby the flue body and head piece are formed to be displaceable to one another by means of respective tube pieces that slide into one another, in order to enable a fine-tuning of the absolute intonation, for example, because of changing temperatures or play. However, this reference contains nothing regarding the manner or structure of the sliding connection between the flute body and head piece.

By using known embodiments of a piccolo, the connection made possible by a displacement of the flute body and head piece to one another is provided, in that on the flute body, an axially projecting, hollow-cylindrical pin with an external cork seal as a tube piece is formed, which has an inner bore for conveyance of the air blown in via the attached head piece. The likewise hollow-cylindrically formed head piece is formed in a section of an inner space facing the flute body to be connected, with an enlarged diameter, in which a pin tube is arranged, which has a smaller outer diameter as the inner diameter of the head piece body, so that an annular chamber is formed between the pin tube and the head piece body. If necessary, inside of the head piece body, a receiving sleeve is arranged about the pin tube to form the annular chamber. The front face of the head piece with the receiving sleeve projects over the front face of the pin tube, so that the pin tube is arranged to be set back relative to this end of the head piece body. The flute body, with its projecting pin, is displaced into the annular chamber formed in the head piece body and displaceably arranged therein also for fine tuning of the pitch, whereby during playing of the piccolo, the air blow into the head piece via the mount hole flows over the pin tube of the head piece and the inner bore connected thereto of the hollow-cylindrical pin located on the flute body, and into the flute body.

It is understood that also with reference to the required sealing, a tighter and also rotationally-secured seat of the head piece on the pin of the flute body can be provided. In this connection, the pin tube and if necessary also the receiving sleeve inserted into the head piece body is fixedly connected with the head piece body, for example, adhered.

A disadvantage connected to known piccolos is that only flute bodies and head pieces of the same manufacturer can be connected to a piccolo, because the individual manufacturers, respectively, use different diameters for the tube pieces that engage in one another on the flute body and head piece. Additionally, with the piccolo, because of the pitch adjustment as well as the respective adaptation of the flute body and head piece relative to the lengths of the tube pieces that engage in one another and because the manufacture therefore uses different lengths, exchange of the flute body and head piece between different manufactures also is not possible.

It has been demonstrated that individual musicians, based on their blowing technique with had pieces of one or more manufacturers may use better harmonically or individually adapted head pieces, so that, however, in view of the tone of the piccolo, definitely prefer flute bodies of another manufacturer. The combination of a head piece originating from one manufacturer or individually manufactured head piece with a flute body originating from a different manufacturer is excluded, however, with known piccolos.

SUMMARY OF THE INVENTION

The invention is therefore based on the object of providing a piccolo flute with the above-noted features, which make possible a combination of different flute bodies and head pieces.

This object is solved by a piccolo with the above-noted features, in which, on the end of the head piece to be connected with the flute body, a in tube that axially projected from a head piece body is arranged and an annular adapter socket is interchangeably slid onto the pin tube and is secured onto the pin tube, whereby the adapter socket forms over a partial region of its longitudinal extension with its inner wall surrounding the pin tube of the head piece with spacing, an annular chamber defined between the pin tube and the adapter socket, in which the flute body engages with a hollow-cylindrical pin facing the head piece to form a play-free seat.

An advantage is connected with the present invention, specifically that a head piece formed according to the present invention, for example cut for a musician, is useable on a flute body of a different manufacturer, whereby only an adapter socket adapted to the pin located on the flute body of a specific manufacture is to be placed onto the pin tube of the respective head piece.

According to alternative embodiments of the invention, it can be provided that the adapter socket is fixed by means of an established press fit or by means of a corresponding provided threaded connection.

In so far as the pin tube according to one embodiment of the invention is fixedly connected with the head piece, this arrangement certainly provides an adaptive assembly of the outer diameter of the pin tube located on the head piece to the diameter of the hollow-cylindrical pin located on the flute body, so that the pin is displaceably into the annular chamber of the head piece. In this connection, different flute bodies with differently formed adapter sockets can be associated with a smaller number of head pieces, as is the case with the state of the art.

A further improvement according to an embodiment of the invention provides that the pin tube is interchangeably secured to the head piece body. Thus, pin tubes as well as adapter sockets represent variable components, which enables assembly of flute bodies and head pieces of different manufacturers in any combination The present invention thus provides that the end of the exchangeable pin tube that cooperates with the head piece, respectively, can be secured for example, with a sealed press fit of the same form onto the head piece.

Alternatively, for exchangeable fixing of the pin tube to the head piece body, it can be provided that the pin tube provided with an outer threading is screwed into a sleeve provided with inner threading, which is secured in the head piece body, and rests with its inner end in a widened region formed in the wall of the head piece body to form a continuous smooth inner wall of the head piece body and pin tube and contacts sealingly with its front face against the end of the widened region.

With regard to the cooperation of the adapter socket and the pin tube of the head piece that receives this, according to another embodiment of the invention, it can be provided that the annular adapter socket has an adapter ring that is fixedly connected to it and which extends on its side facing the head piece body on the inside over a part of its longitudinal extension, whose inner diameter corresponds to the outer diameter of the pint tube for providing a play-free press fit. Alternatively, also a threaded connection can be provided.

It should be noted with regard to the combination of the flute bodies and the head pieces and the lengths of the respective connections of flute bodies and head pieces to another permitted by a displacement of the parts relative to one another, that for manufacturing of a rough length adjustment, it is provided that the distance between the flute body and the head piece, which affects the pitch of the piccolo, is adjustable by means of an intermediate ring arranged between the front face of the adapter socket and the head piece body, which is interchangeably displaceable on the pin tube projecting from the head piece. Fine-turning of the pitch is possible or necessary, however, by a fine displacement of the flute body and head piece relative to one another.

BRIEF DESCRIPTION OF THE DRAWINGS

In the drawings, embodiments of the invention are provided, which will be described below. In the drawings.

DETAILED DESCRIPTION OF THE PREFERRED EMBODIMENTS

Figure 2:
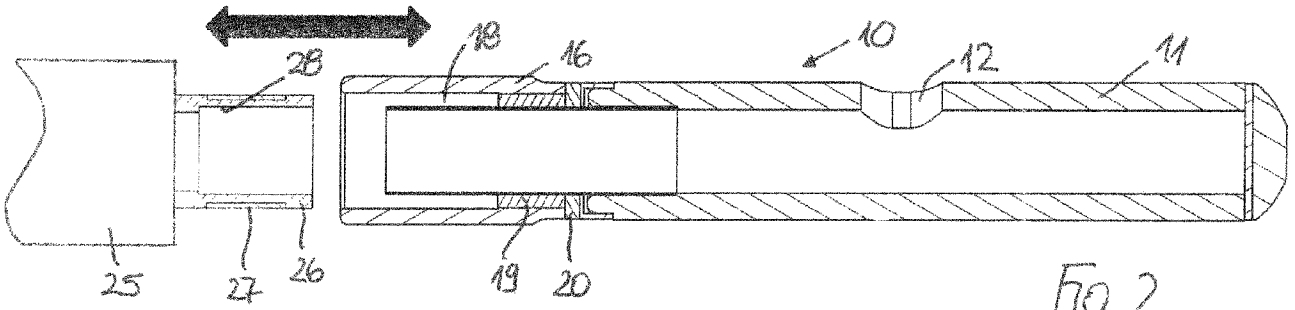
FIG. 2 shows the assembly of the head piece according to FIG. 1 for positioning on a schematically represented flute body.
Figure 1:
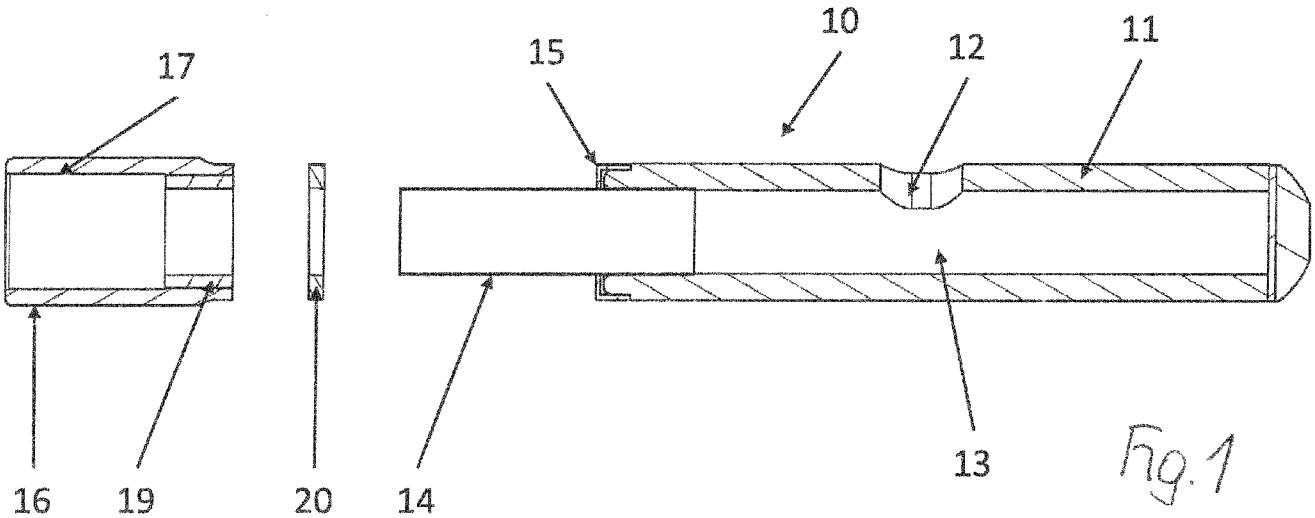
FIG. 1 shows a head piece of a piccolo in a lateral sectional view of its individual parts shown disassembled.

The head piece 10 shown in FIG. 1 has a head piece body 11, in whose wall a bowing hole 12 is formed, via which air can be blown into the interior space 13 of the hollow-cylindrical head piece body 11. A pin tube 14 is inserted on the end (in FIG. 1, left) of the head piece body 11 provided for placement of the head piece 11 on a flute body 15 of a piccolo (FIG. 2). The pin tube 14 projects with a partial region over the front face of the head piece body and with another partial region, lies in the interior space 13 of the head piece 10. The front face of the head piece body 11 is thus protected by a protective cap 15, which also can be pulled up for holding the pin tube 14 on the head piece body 11.

On the projecting end of the pin tube 14, an adapter socket 16 is displaceable, in whose interior, an adapter ring 19 is positioned on the side facing the head piece body 11. The inner diameter of the adapter ring 19 determined, such that the outer diameter of the pin tube 14 is displaceable onto the pin tube 14 and is held thereon in a press fit. In the region lying outside of the adapter ring 19, the adapter socket 16 or its inner wall 17 has a diameter, such that an annular chamber 18 is provided upon displacement of the adapter socket 16 onto the pin tube 14 (FIG. 2). In this annular chamber 18, upon assembly of the head piece 10 and flute body 25, a hollow-cylindrical pin 26 located on the flute body 25 is displaceable with its annular wall.

For a length adjustment from another attached head piece 10 and flute body, an intermediate ring 20 is displaced onto the pin tube 14, which can have selectively a different width, depending on linear measurements of the head piece 10 and flute body. The intermediate ring 20 comes to rest between the front faces that face one another of the head piece body 11 and the adapter socket 16, whereby the protective cap 15 located on the head piece body 11 serves also as a stop for the displaced intermediate ring 20.

So far as FIG. 2 illustrates the assembly of the individual parts described with reference to FIG. 1, the annular chamber 18 is provided between the outer circumference of the pin tube 14 and the inner wall 17 of the adapter socket 16. In this annular chamber 18, upon attachment of the head piece 10 to a flute body 25 as shown in FIG. 2, a hollow-cylindrical pin 26 located on the flute body 25 is displaceable with its annular wall, whereby on the outer circumference of the hollow-cylindrical pain 26, a seal 27 is arranged. Thus, it can be recognized that in the wall of the pin 26 in the inside, a widened portion 289 for receipt of the respective end of the pin tube 14 is formed, so that upon assembly of the flute body 25 and head piece 10, a smooth wall for the air flow-through is provided.

Figure 4:
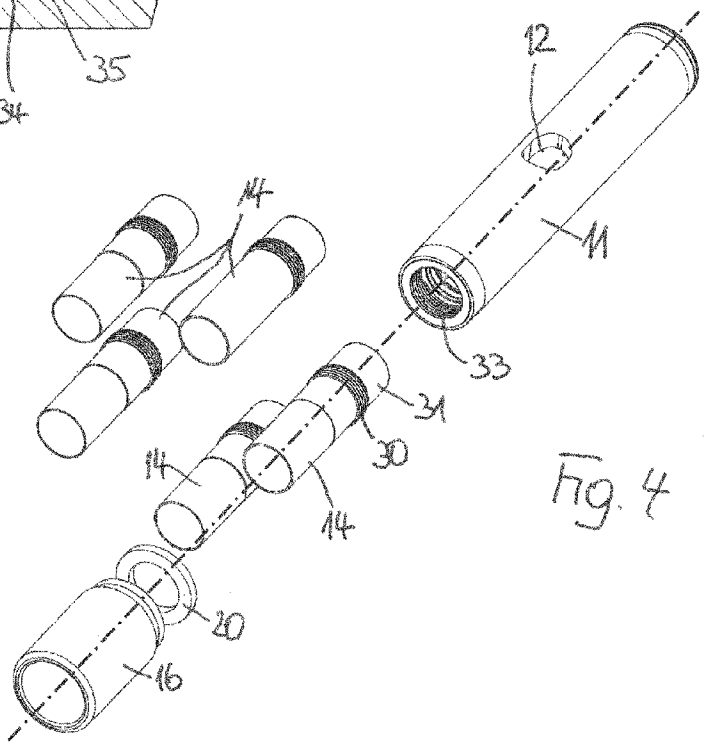
FIG. 4 shows the embodiment according to FIG. 2 with different pin tubes in a perspective view of the disassembled individual parts.
Figure 3:
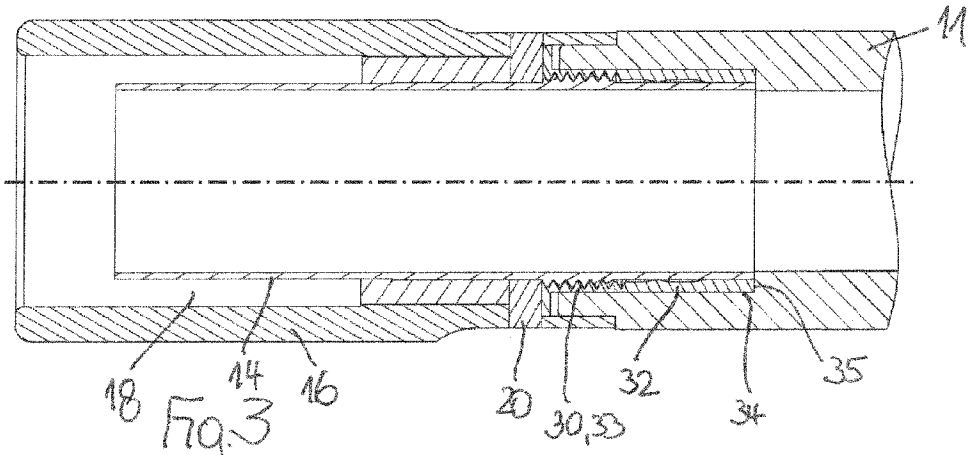
FIG. 3 shows another embodiment of the head piece in assembly in a representation corresponding to FIG. 2.

In FIGS. 3 and 4, an embodiment is further provided, in which the pin tube 14 is exchangeably fixable to the head piece body 11, so that additional, differently formed pin tubes 14 can be used.

With the embodiments shown in FIGS. 3 and 4, each of the pin tubes 14 have an outer thread 30 on a partial region of its extension, so that en insertion section 31 that is inserted into the head piece body 11 is provided. On the end of the head piece body 11 that receives the pin tube 14, in its interior, a sleeve 32 is inserted with its inner threading 33 and for example, is attached by adhesion, so that different pin tubes 14 can be screwed into the sleeve 32 located in the head piece body 11 with their outer threads 30 formed on them. As with the connection of flute body pins 26 and head piece 10, also with the connection of pin tube 14 and head piece body 11, the wall of the head piece body 11 is provided with a radial widened region 34, which on the one hand, is oriented for receiving the sleeve 32 and additionally, also takes into consideration the length of the insertion section 31 of the pin tube 14, such that the pin tube 14 with its inner end abused sealingly against a front-side section adjacent the widened region 34. In other respects, the structure of the head piece 10 and the assembly with the flute body 25 correspond to the embodiment shown in FIG. 2.

The specification incorporates by reference the disclosure of German patent application DE 102014105180, filed Apr. 11, 2014.

The present invention is, of course, in no way restricted to the specific disclosure of the specification and drawings, but also encompasses any modifications within the scope of the appended claims.

I claim:

1. A piccolo, comprising:

a flute body (25) with tone holes;

a head piece (10) having a mouth hole (12) and a head piece body;

at least one tube piece formed, respectively, on the flute body (25) and head piece (10), wherein the flute body (25) and the head piece (10) are connectable to one another via said at least one tube piece, where said at least one tube piece slidingly engage in one another, and wherein the flute body (25) and head piece (10) are displaceable relative to one another based on said slidingly arranged at least one tube piece;

an axial pin tube (14) formed on an end of the head piece (10) to be connected with the flute body (25) and projecting from the head piece body;

an annular adapter socket (16) configured to be slidingly and interchangeably positioned onto the pin tube (14) and secured to the pin tube (14);

an annular space (18) formed by the adapter socket (16) and defined between the pin tube (14) and adapter socket (16) over a partial region of a longitudinal extension of the adapter socket, wherein an inner wall (17) of the adapter socket (16) surrounds the pin tube (14) of the head piece (10) with spacing, and wherein the flute body (25) engages in the annular space (18) with a hollow-cylindrical pin (26) oriented toward the head piece (10) to form a play-free seat.

2. The piccolo according to claim 1, wherein the adapter socket (16) is secured on the pin tube (14) via a press fit.

3. The piccolo according to claim 1, wherein the adapter socket (16) is fixed to the pin tube (14) via a threaded connection.

4. The piccolo according to claim 1, wherein the pin tube (14) is fixedly connected with the head piece body (11).

5. The piccolo according to claim 1, wherein the pin tube (14) is interchangeably secured to the head piece body (11).

6. The piccolo according to claim 5, wherein the pin tube (14) is secured by means of a sealed press fit on the head piece body (11).

7. The piccolo according to claim 5, wherein the pin tube (14) is provided with an outer threading (30), wherein said pin tube (14) is configured to be screwed into a sleeve (32) that is provided with inner threading (31) and secured in the head piece body (11), wherein said pin tube (14) rests with an inner end in a widened region (34) formed in a wall of the head piece body (11) to form a continuous smooth inner wall of the head piece body (11) and the pin tube (14), and wherein a front face of said pin tube (14) sealingly contacts an end of the widened region (34).

8. The piccolo according to claim 1, further comprising an adapter ring (19) fixedly connected to the annular adapter socket (16) on a side of the adapter socket (16) facing the head piece body (11) on the inside, the adapter ring (19) extending over a part of the longitudinal extension of the adapter socket (16), wherein the adapter ring (19) has an inner diameter that corresponds to an outer diameter of the pin tube (14) for adjustment of a press fit that is free of play.

9. The piccolo according to claim 1, wherein a spacing between the flute body (25) and the head piece (10) that determines the pitch of the piccolo is adjustable via an intermediate ring (20) interchangeably displaced on the pin tube (14) projecting from the head piece (10), wherein the intermediate ring (20) is arranged between a font face of the adapter socket (16) and the head piece body (11).

10. The piccolo according to claim 1, wherein the hollow cylindrical pin (26) arranged on the flute body (25) is provide on its outer circumference with a seal (27).

* * * * *